United States Patent [19]

Dupont

[11] Patent Number: 4,866,813

[45] Date of Patent: Sep. 19, 1989

[54] LOAD CARRYING ATTACHMENT HANDLE WITH ATTACHMENT STRAP

[76] Inventor: André Dupont, 115 rue De Vaudreuil, Boucherville, Quebec, Canada, J4B 1K7

[21] Appl. No.: 291,283

[22] Filed: Dec. 28, 1988

[51] Int. Cl.[4] ..... A45F 5/00; B65D 25/28

[52] U.S. Cl. ..... 16/114 R; 16/DIG. 25; 81/3.43; 81/64; 294/31.2; 294/153

[58] Field of Search ..... 16/114 R, 114 A, DIG. 25; 81/3.43, 64; 294/31.2, 153

[56] References Cited

U.S. PATENT DOCUMENTS

| | | | |
|---|---|---|---|
| 786,505 | 4/1905 | Loofbourrow | 81/3.43 |
| 961,894 | 6/1910 | Peters | 81/3.43 |
| 1,523,228 | 1/1925 | Marke | 81/3.43 |
| 1,828,106 | 10/1931 | Ertola | 81/65 |
| 2,655,824 | 10/1953 | Land et al. | 81/3.43 |
| 2,789,002 | 4/1957 | Nicholas | 294/31.2 |
| 2,790,669 | 4/1957 | Crawford | 294/31.2 |
| 3,311,399 | 3/1967 | Holton | 294/31.2 |
| 3,431,007 | 3/1969 | Paulsen et al. | 294/31.2 |
| 4,310,110 | 1/1982 | Dexter | 294/31.2 X |
| 4,524,483 | 6/1985 | Lynham et al. | 16/114 R |
| 4,615,073 | 10/1986 | Haak | 16/253 |
| 4,656,566 | 4/1987 | Kelley | 16/DIG. 40 X |

*Primary Examiner*—Richard K. Seidel
*Assistant Examiner*—William Scott Andes

[57] ABSTRACT

A load carrying handle for securement to an article to be hand-supported or displaced. The carrying handle comprises a handle grip having a strap retaining elongated cavity therein. The cavity has an open end and a bottom end wall. An article attaching element having at least a flat grip attaching portion is also provided. A wedge rod is disposed in tight fit in the cavity with the attaching portion of the attaching element wedged between the wedge rod and extends over opposed sides of the wedge rod and an inner end thereof. The wedge rod is dimensioned so that an outer end thereof terminates substantially flush with a peripheral end wall of the handle grip about the open end so that when the carrying handle is secured to an article and the attaching element is secured tightly about the article, the wedge rod outer end will abut the object and provide a solid connection therewith with the attaching portion held secured between the handle grip and wedge.

8 Claims, 1 Drawing Sheet

LOAD CARRYING ATTACHMENT HANDLE WITH ATTACHMENT STRAP

BACKGROUND OF INVENTION

1. Field of Invention

The present invention relates to a load carrying handle which is securable to an article to be hand-supported or displaced thereby making it easier to handle articles which are heavy or hard to grip.

2. Description of Prior Art

In the prior art various attempts have been made to provide attachments which can be secured to heavy articles or articles which are difficult to handle to make it easier to support them. For example, reference is made to U.S. Pat. No. 1,828,106 which discloses a handle construction which is attachable to an object to be carried. However, this handle construction has many parts, is difficult to assemble and install on an object to be supported, and does not offer safety to the person handling heavy objects as the strapping is not positively secured to the handle grip portion and can become detached. Thus, this type of load carrying handle is unsafe to the user.

SUMMARY OF INVENTION

It is a feature of the present invention to provide a load carrying handle for securement to an article to be hand-supported or displaced, and which substantially overcomes all of the above-mentioned disadvantages of the prior art.

Another feature of the present invention is to provide a load carrying handle for securement to an article to be hand-supported or displaced, and wherein the load carrying handle is easy to construct, easy to install, and safe to use.

Another feature of the present invention is to provide a load carrying handle for securement to an article to be hand-supported or displaced, and which is economical to construct and easy to assemble.

According to the above features, from a broad aspect, the present invention provides a load carrying or displaced. The carrying handle comprises a handle grip having a strap retaining elongated cavity therein. The cavity has an open end and a bottom end wall. An article attaching element having at least a flat grip attaching portion is also provided. A wedge member is disposed in tight fit in the cavity with the attaching portion of the attaching element wedged between the wedge member and extends over opposed sides of the wedge member and an inner end thereof. The wedge member is dimensioned so that an outer end thereof terminates at least flush with a peripheral end wall of the handle grip about the open end so that when the carrying handle is secured to an article and the attaching element is secured tightly about the article, the wedge rod outer end will abut the object and provide a solid connection therewith with the attaching portion held secured between the handle grip and wedge.

BRIEF DESCRIPTION OF DRAWINGS

A preferred embodiment of the preferred invention will now be described with reference to the examples thereof as illustrated in the accompanying drawings in which.

DESCRIPTION OF PREFERRED EMBODIMENTS

Figure 1:
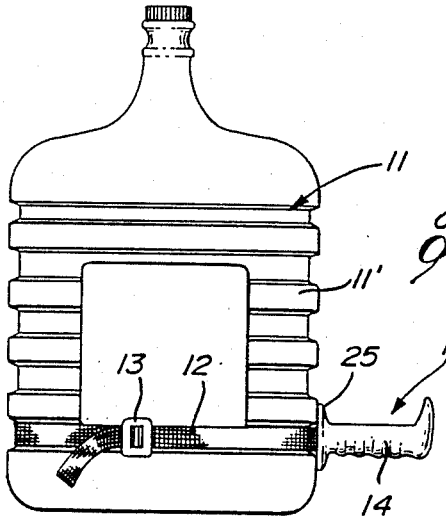
FIG. 1 is a perspective view showing the load carrying handle of the present invention secured to a heavy water bottle.
Figure 2:
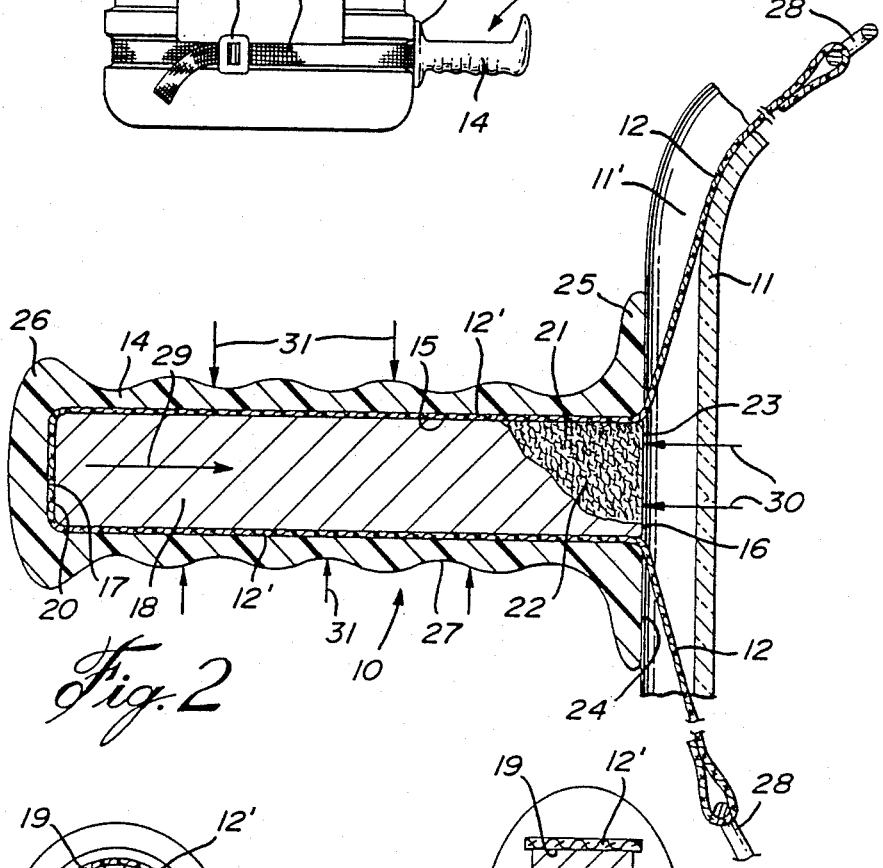
FIG. 2 is a fragmented cross-sectional view showing the construction of the load carrying handle.

Referring now to the drawings, and more particularly to FIGS. 1 and 2, there is shown generally at 10 the load carrying handle of the present invention. As shown in FIG. 1, the handle is secured to a heavy water bottle 11 and attached thereto by an attaching element 12, herein an adjustable strap provided with a slip-proof buckle 13. As shown in FIG. 2, the load carrying handle 10 is comprised of a handle grip 14 having a strap retaining elongated cavity 15 therein. The cavity has an open end 16 and a bottom end wall 17. The article attaching element 12 is provided with at least a flat grip attaching portion 12' for securement within the handle grip 14 by a wedge element, herein a rod 18 which is disposed in tight fit in the cavity 15.

Figure 3A:
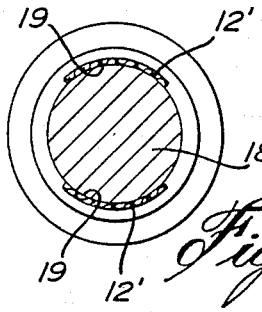
FIGS. 3A and 3B are end view of the load carrying handles showing a wedge rod or circular and rectangular cross-sections.
Figure 3B:
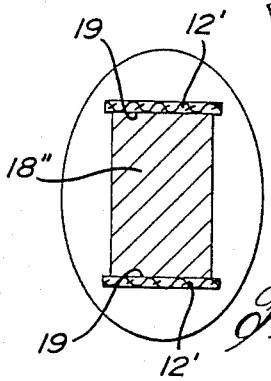

As shown in FIGS. 3A and 3B, the wedge rod 18 may have a circular cross-section as shown at 18' or a rectangular cross-section as shown at 18''. The flat grip attaching portion 12' of the strapping element 12 is looped over opposed side wall portions 19 of the wedge rod and extends over the end wall 20 thereof so that it is tightly held wedged into the handle grip between the handle grip cavity inner wall and the wedge rod 18.

The wedge rod 18 may be formed from wood or may be molded of plastics with the outer surface 21 thereof being formed with a gripping texture 22 to grip with the inner surface of the cavity 15.

The handle grip 14 is also preferably formed of a deformable material such as polyvinyl chloride, rubber or like flexible and pliable material, having a good 1 surface texture to prevent the handle grip from slipping off the rod 18.

The wedge rod 18 is also dimensioned for tight friction fit within the cavity 15, and is preferably press-fitted therein. The wedge rod is also dimensioned so that the outer flat end wall 23 thereof terminates at least flush with the peripheral end wall 24 of the handle grip 14. The end wall 23 may also be provided with a pad element (not shown). As herein shown, the handle grip is formed with an outer flange wall 25 and an enlarged knob end 26 to provide protection to the user's hand, and to provide a better grip about the handle grip 14. Also, the handle grip may be formed with finger-locating troughs 27 for better handling.

As shown in FIG. 2, the strapping element 12 may also be formed as a flat strap attaching section provided with end connectors 28 so that the handle could be attached by any strapping type element, such as a rope or strap provided with its own buckles (not shown), so that the handle grip may be secured to any type object. Also, more than one of these handle grips may be secured to an object for carrying by one or more persons.

Referring again to FIGS. 1 and 2, it can be shown that in use the carrying handle is secured to an object, such as the bottle 11, by tightly securing the strapping element 12 about a portion of the bottle 11. When the strapping element 12 is tightened the outer end wall 23 of the wedging rod 18 is in abutment with the outer wall 11′ of the object by the pulling force exerted on the wedge rod 18 by the strapping element over the bottom end wall 17 of the wedge rod thereby applying a pressure in the direction of arrow 29. Thus, there is a force exerted against the object outer wall 11′ and the outer end wall 23 of the wedge rod, as illustrated by arrows 29 and 30. Therefore, the handle is firmly held in position and there is no pulling strain on the handle grip 14, as all of the strapping force is on the wedge rod 18. However, the handle grip is held secured during use by pressure exerted by the user's hand applying a transverse force in the direction of arrows 31 about the wedge rod so that the attaching portion of the strap is held secure between the handle grip and wedge by this hand pressure of the person holding the handle grip. Thus, the load carrying handle is extremely safe to use and its component parts cannot become accidentally detached in use.

It is within the ambit of the present invention to cover any obvious modifications of the preferred embodiment described herein, provided such modifications fall within the scope of the appended claims.

I claim

1. A load carrying handle for securement to an article to be hand-supported or displaced said carrying handle comprising a handle grip having a strap retaining elongated cavity therein said cavity having an open end and a bottom end wall an article attaching element having at least a flat grip attaching portion, and a wedge member disposed in tight fit in said cavity with said attaching portion of said attaching element wedged between said wedge member and extending over opposed sides of said wedge member and an inner end thereof, said wedge member being dimensioned so that an outer end thereof terminates substantially flush with a peripheral end wall of said handle grip about said open end so that when said carrying handle is secured to said article and said attaching element is secured tightly about said article, said wedge member outer end will abut said article and provide a solid connection therewith with said attaching portion held secured between said handle grip and wedge member said handle grip being formed of a deformable material such as polyvinyl chloride, said wedge element being a rod having an outer wall with a good frictional retention characteristic with said material of said handle grip and being press-fitted in said cavity.

2. A load carrying handle as claimed in claim 1 wherein said strap retaining elongated cavity is of circular cross-section and has a flat bottom wall.

3. A load carrying handle as claimed in claim 1 wherein said strap retaining elongated cavity is of rectangular cross-section and has a flat bottom wall.

4. A load carrying handle as claimed in claim 1 wherein said article attaching element is a flat strap having opposed free ends interconnectable through an adjusting element.

5. A load carrying handle as claimed in claim 4 wherein said adjusting element is a buckle secured to an end of one of said free ends.

6. A load carrying handle as claimed in claim 1 wherein said flat grip attaching portion of said attaching element is a flat strap portion having a connector at each free end thereof for securement to a strapping element.

7. A load carrying handle as claimed in claim 5 wherein said wedge rod is a wooden rod.

8. A load carrying handle as claimed in claim 1 wherein said wedge rod is moulded of a plastics material and has an outer surface provided with a gripping texture.

* * * * *